US006221489B1

(12) United States Patent
Morita et al.

(10) Patent No.: US 6,221,489 B1
(45) Date of Patent: Apr. 24, 2001

(54) CARBONACEOUS FIBER ACUTE-ANGLED AT BOTH ENDS AND PRODUCTION PROCESS THEREFOR

(75) Inventors: Toshio Morita, Kanagawa; Tamotsu Yamashita, Chiba, both of (JP)

(73) Assignee: Showa Denko Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/444,201

(22) Filed: Nov. 22, 1999

Related U.S. Application Data

(60) Provisional application No. 60/156,716, filed on Sep. 30, 1999, now abandoned.

(30) Foreign Application Priority Data

Nov. 19, 1998 (JP) ..... 10378634

(51) Int. Cl.[7] ..... D01F 9/12
(52) U.S. Cl. ..... 428/367; 423/447.1; 423/447.2
(58) Field of Search ..... 428/364, 367; 423/447.1, 447.2

(56) References Cited

U.S. PATENT DOCUMENTS 5,346,683 * 9/1994 Green et al. ..... 423/447.2
5,641,466 * 6/1997 Ebbesen et al. ..... 423/447.1
5,747,161 * 5/1998 Iijima ..... 428/367

FOREIGN PATENT DOCUMENTS 58-197314 11/1983 (JP) .
60-027700 2/1985 (JP) .
60-215816 10/1985 (JP) .
7-011520 1/1995 (JP) .
7-048110 2/1995 (JP) .
7-150419 6/1995 (JP) .
8-115652 5/1996 (JP) .
10-112257 4/1998 (JP) .

* cited by examiner

*Primary Examiner*—N Edwards
(74) *Attorney, Agent, or Firm*—Sughrue, Mion, Zinn, Macpeak & Seas, PLLC

(57) ABSTRACT

Carbonaceous fibers having sharp ends and which are useful as an electron-emitting material, for example, in cold-cathode display devices. Carbonaceous fibers having a structure such that planes formed of carbon atoms in a condensed ring structure are concentrically grown around a fiber axis then subjected to heating at a temperature of 400–1200° C. in the presence of oxygen.

6 Claims, 2 Drawing Sheets

CARBONACEOUS FIBER ACUTE-ANGLED AT BOTH ENDS AND PRODUCTION PROCESS THEREFOR

CROSS REFERENCE TO RELATED APPLICATIONS

This application is an application filed under 35 U.S.C. § 111(a) claiming benefit pursuant to 35 U.S.C. § 119(e)(i) of the filing date of Provisional Application 60/156,716 filed Sep. 30, 1999 pursuant to 35 U.S.C. § 111(b).

FIELD OF THE INVENTION

The present invention relates to carbonaceous fibers having sharp ends, and to a process for producing such carbonaceous fibers.

More particularly, the invention relates to carbonaceous fibers which have sharp ends and which are useful as an electron source for field emission or the like, for example, in a cold-cathode type display device, and to a process for producing such carbonaceous fibers.

BACKGROUND OF THE INVENTION

Recently, there has been investigated the use of carbonaceous fibers as an electron source of an electron-emitter in a cold cathode employed in a device such as an electronic display device or an imaging device.

With regard to processes for producing such carbonaceous fibers, Japanese Patent Application Laid-Open (Kokai) No. 8-115652, for example, discloses carbonaceous fibers deposited through pyrolysis of hydrocarbon gas serving as a raw material in a microcavity forme d between two electrodes, each electrode being disposed on an insulated substrate.

Japanese Patent Application Laid-open (kokai) No. 10-112257 discloses a process for gas phase synthesis of diamond-like carbon, including steps of implanting carbon ions or carbon cluster ions on a substrate cathode surface to thereby form nucleating sites, and growing diamond-like carbon from the sites.

Although these processes can be carried out from a technical standpoint, the processes involving a thermal treatment step, however, have an adverse effect on the cathode material. Therefore, heat treatment of the formed carbonaceous fibers is not an acceptable technique for limiting the emission of electrons.

Moreover, since these processes involve direct formation of carbon on a substrate such as a cathode, mass production requires unique know-how, as well as special facilities and manufacturing techniques. Thus, due to such requirements, manufacturers of cathode materials generally do not employ such processes.

In recent years, carbon nanotubes having a diameter of some 10 nm or less have been studied as an electron-emitting material. A carbon fiber nanotube is a tube formed of graphite and typically has a diameter of 1–50 nm. Such a product can be formed by deposition on an electrode by arc discharge of a carbon electrode or by application of a high-intensity laser beam to a carbon electrode in a suitable atmosphere. The nanotube typically has one sharp end. See, for example, *Chemistry Today, p.*57, July, 1998.

Carbon nanotubes have chemical stability and high mechanical toughness, and applications thereof as electron sources for field emission are currently being investigated. For example, Saito et al. disclose in *Ceramics,* 33, (1998), No. 6, a fluorescent display device in which a number of carbon nanotubes are attached to a cathode plate. The authors indicate possible use of carbon nanotubes in a display device such as a low-power planar display device or an ultrafine color CRT.

However, no suitable industrial process for producing carbon nanotubes has yet been established, and thus inexpensive carbon nanotubes of stable quality have not been available in commercial quantities.

Recently, vapor-grown carbon fibers having a structure similar to that of carbon nanotubes and with a diameter on the order of several microns have been produced on a large scale. As disclosed in Japanese Patent Publication (Kokoku) No. 04-24320 and Japanese Patent No. 2778434, the above type of carbon fiber is produced by spraying an organic compound in a reactor to thereby pyrolyze the compound. Precise examination of the thus-obtained fiber has revealed that the fiber is composed of planes of carbon atoms having a condensed ring structure concentrically grown around the longitudinal axis of the fiber. The fiber has a spherical closed end or a cut end having a cross-section in a plane approximately normal to the fiber axis.

If the fiber has a sharp end, carbon atoms of a condensed ring structure appear in the edge plane, to thereby enhance the field emission characteristic of the carbonaceous fiber when used as a field emission source.

However, a carbonaceous fiber having two sharp ends has not been found. Use of such a carbonaceous fiber as an electron-emitting material is expected to have an effect of increasing emission efficiency.

SUMMARY OF THE INVENTION

The present inventors have considered that a vapor-grown carbon fiber produced using an industrially established process can be employed in order to produce a carbonaceous fiber having sharp ends and which is suitable for use as an electron-emitting material.

In view of the foregoing, an object of the present invention is to provide carbonaceous fibers produced through a conventional process but which additionally have suitable sharp ends. Another object of the invention is to provide a process for producing such fibers on a large scale.

The present inventors have investigated a variety of methods for forming a sharp end on an existing type of carbonaceous fiber including subjecting the fiber to mechanical impact and effecting wear to the tip of the fiber, and have found that heating the carbonaceous fiber during formation in the presence of oxygen effectively forms sharp ends on the fiber. The present invention has been accomplished on the basis of this finding, to thereby provide a carbonaceous fiber having sharp ends.

Accordingly, the present invention provides a carbonaceous fiber having a structure such that planes formed of carbon atoms in a condensed ring structure are concentrically grown around the fiber axis, with the fiber having both ends sharp. Such a carbonaceous fiber may be characterized by $d_1/d_0<0.5$ and $L/d_0>0.5$, where $d_0$ is the main diameter of the carbonaceous fiber, $d_1$ is the diameter at the end of the carbonaceous fiber, and L is the distance from the end of the carbonaceous fiber to the point where the diameter starts to decrease. The carbonaceous fiber may have a hollow structure around and along the fiber axis.

The invention further provides carbonaceous fibers having a structure such that planes formed of carbon atoms in a condensed ring structure are concentrically grown around the fiber axis, and which comprise a mixture of carbonaceous fibers having sharp ends and carbonaceous fibers having one or two non-sharp ends. The carbonaceous fibers may have a hollow structure around and along the fiber axis. Such carbonaceous fibers may comprise over 10% of carbonaceous fibers having sharp ends. These carbonaceous fibers may have a hollow structure around and along the fiber axis.

The fibers of the invention can be produced by a process for producing carbonaceous fibers having sharp ends including vapor growing carbonaceous fibers composed of planes of carbon atoms in a condensed ring structure arranged concentrically around the longitudinal axis of the fiber, and then heating the resulting carbonaceous fibers to a temperature of 400–1200° C. in the presence of oxygen. For this process, fired or graphitized carbon fiber can be used as the raw material.

According to another aspect of the present invention, carbonaceous fibers having sharp ends are produced by providing carbon nanotubes, and then heating the carbon nanotubes to a temperature of 400–1200° C. in the presence of oxygen.

DESCRIPTION OF THE PREFERRED EMBODIMENTS

Preferred embodiments of the present invention will next be described in detail. The carbonaceous fiber according to the present invention, which has a structure such that planes formed of carbon atoms in a condensed ring structure are concentrically grown around the fiber axis, can be a vapor-grown carbon fiber or a carbon nanotube. The carbonaceous fiber may have a hollow space around the fiber axis.

Suitable vapor-grown carbon fibers are disclosed in Japanese Patent Publication (Kokoku) No. 4-24320, Japanese Patent No. Al., 2778434, etc. The carbon nanotube was discovered by Iijima et al., and a variety of processes for producing carbon nanotubes have already been proposed. In the present invention, no particular limitation is imposed on the process for producing vapor-grown carbon fibers or carbon nanotubes. However, the present inventors have found that carbonaceous fibers having sharp ends according to the present invention can be obtained from vapor-grown carbon fibers in which planes formed of carbon atoms in a condensed ring structure are concentrically grown around the fiber axis.

Figure 1:
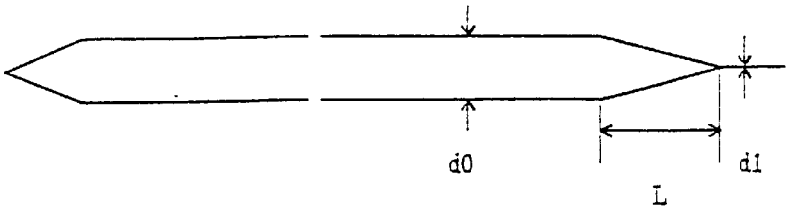
FIG. 1 is an explanatory diagram for defining a state of sharp ends according to the present invention in the case where the sharp point is aligned with the longitudinal axis of the fiber.

The term "sharp end" is defined, as shown in FIG. 1, as being characterized by the following relationships: $d_1/d_0<0.5$ and $0.5<L/d_0$, where do is the main diameter of the carbonaceous fiber, $d_1$ is the diameter of the end portion of the fiber, and L is the distance between the point where the fiber diameter starts to decrease and the end point.

Figure 2:
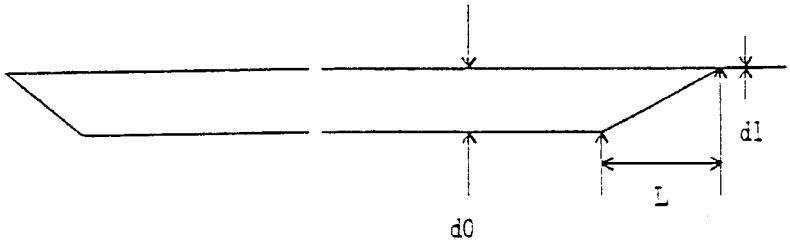
FIG. 2 is a view similar to FIG. 1 but showing a case where the sharp point is offset from the axis of the fiber.

Although the sharp end typically is aligned with the fiber axis, the sharp end may be offset from the fiber axis, as shown in FIG. 2.

Figure 3:
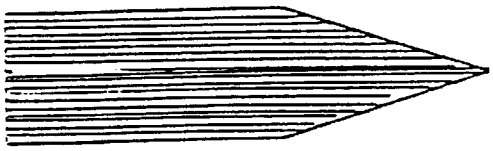
FIG. 3 is a longitudinal view showing the structure of a carbonaceous fiber having sharp ends.
Figure 4:
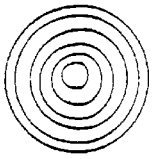
FIG. 4 is an end view of the carbonaceous fiber of FIG. 3.

As shown in FIG. 3, the structure of the end of the fiber is such that planes formed of carbon atoms in a condensed ring structure are concentrically grown around the fiber axis, with space between the planes, and the fiber may or may not have a hollow space along and around the fiber axis in the fiber end portion.

A mixture of the carbonaceous fibers according to the present invention may be a mixture of carbonaceous fibers having both ends sharp and carbonaceous fibers having one or two non-sharp ends. The carbonaceous fibers having both ends sharp may be contained in a proportion of 10% or more based on the entirety of the mixture.

No particular limitation is imposed on the diameter and length of the carbonaceous fibers according to the present invention. Typically, the fibers have a diameter of 0.0005 to 50 $\mu$m and a length of 0.5 $\mu$m to several mm, preferably 0.0005 to 1 $\mu$m and 0.5 to 500 $\mu$m, respectively. The carbonaceous fibers may have a thin portion produced by oxidation of the surface.

The process for producing carbonaceous fibers having sharp ends according to the present invention comprises heating carbonaceous fiber having a structure such that planes formed of carbon atoms in a condensed ring structure are arranged concentrically around the fiber axis at a temperature of 400–1200° C. in the presence of oxygen. When the fiber is heated to a temperature lower than 400° C., oxidation does not occur, to thereby prevent formation of a sharp end, whereas when the fiber is heated to a temperature higher than 1200° C., oxidation proceeds too rapidly, to thereby make appropriate control of the reaction time difficult.

A raw material carbonaceous fiber may be fired at 800° C. or higher or graphitized at 2000° C. or higher. If unfired or un-graphitized raw material carbonaceous fiber is oxidized at a temperature lower than about 400° C., control of the reaction time is difficult.

The temperature and time of heat treatment are regulated in accordance with the hysteresis of the raw material carbonaceous fiber. Graphitization may be carried out after completion of oxidation.

EXAMPLES

The present invention will next be described in more detail by way of examples, which should not be construed as limiting the invention thereto.

As described in Japanese Patent No. 2778434, a vertical eating furnace equipped with a reaction tube having an inner diameter 170 mm and a length of 1500 mm was employed. A two-fluid nozzle was disposed at the top of the reaction tube, and the reactor was maintained at 1200° C. by heating. A raw material containing ferrocene in an amount of 4 wt % and hydrogen were sprayed from the two-fluid nozzle onto an inner wall of the reactor at rates of 20 g/minute and 100 L/minute, respectively. Reaction was carried out for one hour, while vapor-grown carbon fibers formed in the reactor were scraped off at five-minute intervals to thereby obtain vapor-grown carbon fibers, which were subsequently graphitized at 2800° C.

The thus-graphitized carbon fibers were placed in a crucible and heated at 750° C. in a muffle furnace for four hours. Un-graphitized carbonaceous fibers remained in an amount of 21 wt %.

Figure 5:
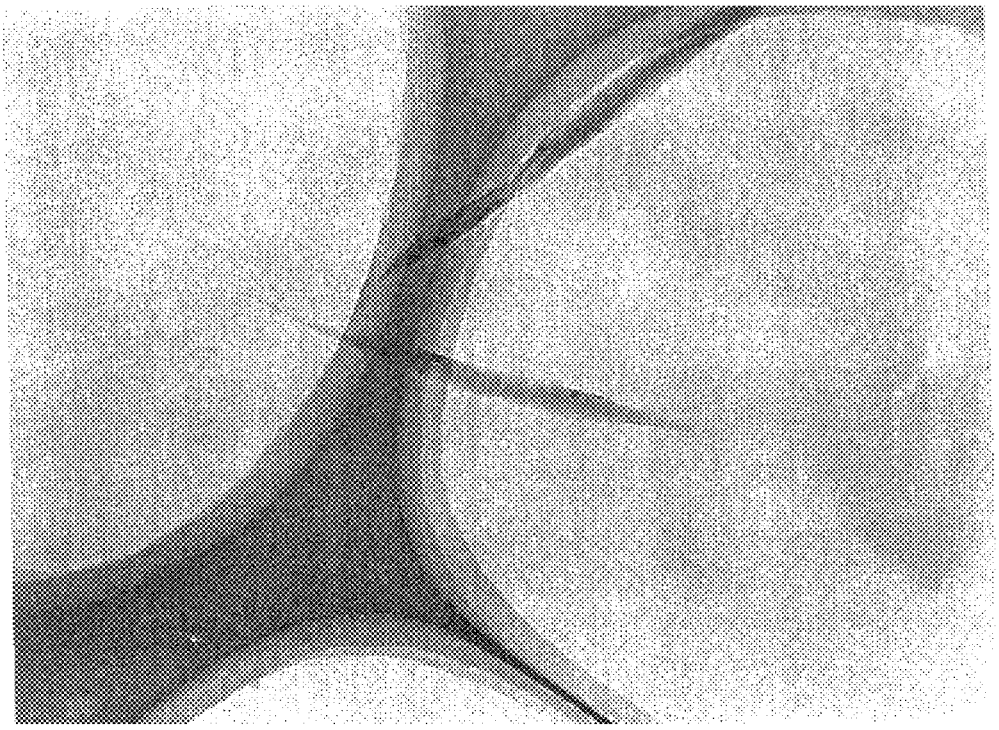
FIG. 5 is a TEM photograph showing one example of a carbonaceous fiber according to the present invention having sharp ends.
Figure 6:
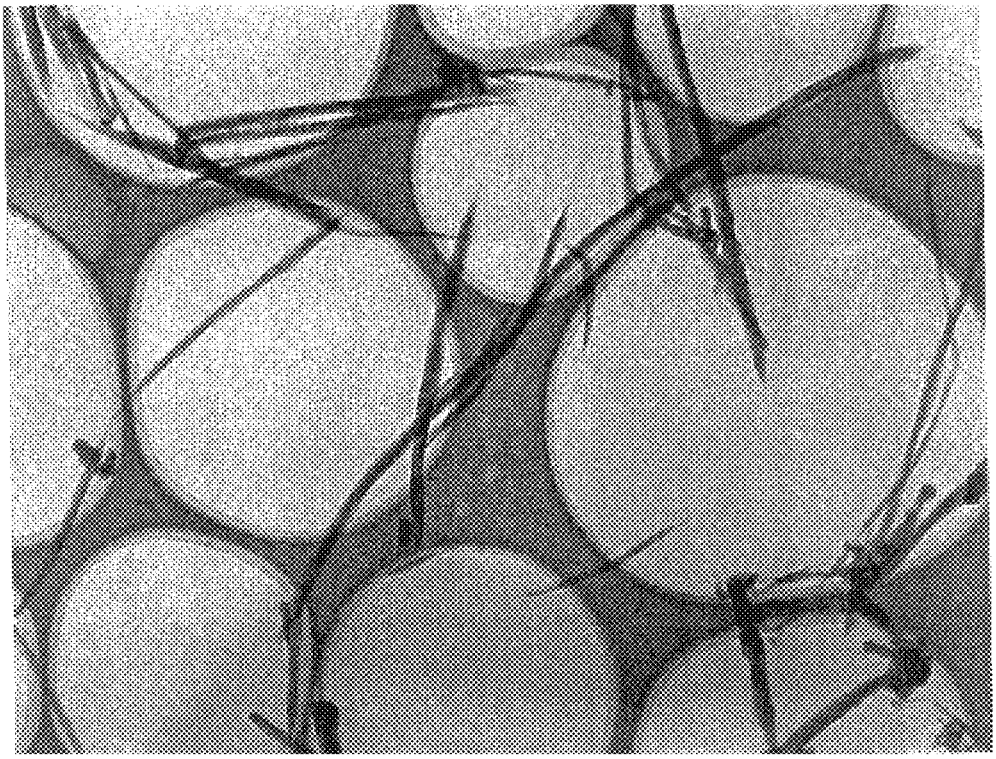
FIG. 6 is a TEM photograph showing another example of a carbonaceous fiber according to the present invention having sharp ends.

The thus-oxidized carbonaceous fibers were observed under a transmission electron microscope (TEM). Photographs obtained from the TEM are shown in FIGS. 5 and 6.

The fiber diameter and dimensional data of carbonaceous fibers having sharp ends are shown in Table 1. In one carbonaceous fiber, $d_1/d_0$ was 0.08, $L/d_0$ was 3.4, $d_1/d_0$ was 0.05, and $L/d_0$ was 5.4. In another carbonaceous fiber, $d_1/d_0$ was 0.13, $L/d_0$ was 1.3, $d_1/d_0$ was 0.06, and $L/d_0$ was 1.9.

TABLE 1

Shape of carbon fibers having sharp ends (units: μm)

| Fiber | $d_0$ | $d_1$ | L | $d_1/d_0$ | $L/d_0$ |
|---|---|---|---|---|---|
| a | 0.10 | 0.008 | 0.35 | 0.08 | 3.4 |
| | | 0.005 | 0.56 | 0.05 | 5.4 |
| b | 0.12 | 0.016 | 0.16 | 0.13 | 1.3 |
| | | 0.008 | 0.24 | 0.06 | 1.9 |

The present invention thus provides, with a simple production method and at low cost and on a large scale, carbonaceous fibers having sharp ends and which are useful as an electron-emitting materials.

While the invention has been described in detail and with reference to specific embodiments thereof, it will be apparent to one skilled in the art that various changes and modifications can be made therein without departing from the spirit and scope thereof.

What is claimed is:

1. A vapor-grown carbonaceous fiber comprising planes formed of carbon atoms in a condensed ring structure concentrically grown around a center longitudinal axis of said fiber, and sharp ends at both ends of said fiber, wherein $d_1/d_0<0.5$ and $L/d_0>0.5$, wherein $d_0$ is a main diameter of said carbonaceous fiber, $d_1$ is a diameter at said sharp ends of said carbonaceous fiber, and L is a distance from said sharp ends of said carbonaceous fiber to a start point where the diameter starts to decrease. said sharp ends of said carbonaceous fiber, and L is a distance from said sharp ends of said carbonaceous fiber to a start point where the diameter starts to decrease.

2. The vapor-grown carbonaceous fiber according to claim 1, wherein said carbonaceous fiber has a hollow structure extending along and around said longitudinal axis.

3. A mixture of vapor-grown carbonaceous fibers, said fibers comprising planes formed of carbon atoms in a condensed ring structure concentrically grown around a center longitudinal axis of said fibers, some of said fibers having both ends wherein $d_1/d_0<0.5$ and $L/d_0>0.5$, wherein $d_0$ is a main diameter of said carbonaceous fiber, $d_1$ is a diameter at said sharp ends of said carbonaceous fiber, and L is a distance from said sharp ends of said carbonaceous fiber to a start point where the diameter starts to decrease, and others of said fibers having only one sharp end.

4. The vapor-grown carbonaceous fiber according to claim 3, wherein $d_1/d_0<0.13$ and $L/d_0>1.3$, wherein do is a main diameter of said carbonaceous fiber, $d_1$ is a diameter at said sharp ends of said carbonaceous fiber, and L is a distance from said sharp ends of said carbonaceous fiber to a start point where the diameter starts to decrease.

5. The mixture of vapor-grown carbonaceous fibers according to claim 3 or 4, wherein more than 10% of said carbonaceous fibers have both ends sharp.

6. The mixture of vapor-grown carbonaceous fibers according to claim 3 or 4, wherein said carbonaceous fibers have a hollow structure extending along and around said longitudinal axis.

* * * * *